US006044683A

United States Patent [19]

Shigemoto

[11] Patent Number: 6,044,683

[45] Date of Patent: Apr. 4, 2000

[54] APPARATUS AND METHOD FOR FORMING JOINTS IN TUBING

[75] Inventor: Hiromi Dick Shigemoto, Round Rock, Tex.

[73] Assignee: Shigemoto & Annett II, Inc., Elgin, Tex.

[21] Appl. No.: 09/165,501

[22] Filed: Oct. 2, 1998

[51] Int. Cl.[7] ..... B21C 37/29

[52] U.S. Cl. ..... 72/335; 29/890.148; 72/370.27

[58] Field of Search ..... 72/70, 112, 333, 72/335, 358, 370.27; 29/890.148

[56] References Cited

U.S. PATENT DOCUMENTS

| | | | |
|---|---|---|---|
| 1,596,029 | 8/1926 | Spire . | |
| 1,792,928 | 2/1931 | Reigart . | |
| 1,850,803 | 3/1932 | Lutz | 72/335 |
| 1,892,712 | 1/1933 | Taylor . | |
| 1,911,653 | 5/1933 | Taylor . | |
| 1,926,353 | 9/1933 | Spatta | 72/370.27 |
| 2,149,508 | 3/1939 | Coe . | |
| 2,240,319 | 4/1941 | Taylor . | |
| 2,292,799 | 8/1942 | Romann et al. . | |
| 2,507,859 | 5/1950 | Keller . | |
| 2,952,070 | 9/1960 | Veatch . | |
| 3,451,113 | 6/1969 | Holden | 29/890.148 |
| 3,683,657 | 8/1972 | Davies | 72/112 |
| 4,106,322 | 8/1978 | Moshnin et al. . | |
| 4,253,224 | 3/1981 | Hickman et al. . | |
| 4,307,593 | 12/1981 | Riggs . | |
| 4,503,693 | 3/1985 | Larikka | 72/70 |

FOREIGN PATENT DOCUMENTS

| | | |
|---|---|---|
| 55-122627 | 9/1980 | Japan . |
| 59-33036 | 2/1984 | Japan . |
| 799 861 | 1/1981 | Russian Federation . |

*Primary Examiner*—Lowell A. Larson
*Attorney, Agent, or Firm*—Fitzpatrick, Cella, Harper & Scinto

[57] ABSTRACT

The present invention relates to an effective method of cold-forming a tee in tubing. The method includes the steps of forming a quadrilobal pilot hole in the tubing, securing the tubing, and forcing a rounded member from the interior of the tubing through the pilot hole to form the tee.

38 Claims, 6 Drawing Sheets

APPARATUS AND METHOD FOR FORMING JOINTS IN TUBING

BACKGROUND OF THE INVENTION

1. Field of the Invention

The present invention relates to a method and apparatus for forming tees in tubing or other metal products. The apparatus and method of this type can work the metal surrounding an opening in the wall of a tube or a plate to flare the edge of the metal surrounding the opening outwardly and increase the size of the opening until an outwardly projecting collar or neck is formed around the enlarged opening. This collar can form a support to which a branch tube can be affixed by welding, for example.

2. Related Background Art

Many methods of manufacturing a branch pipe joint or tee are known. For example, Japanese Laid-Open Patent Application No. 59-33036 discloses forming a branch pipe joint of large diameter by first forming an elliptical hole in the body of a short pipe, fixing the pipe in a forming die having a through-hole, and positioning a receiving stand in the pipe. A small ball is positioned on the receiving stand adjacent the elliptical hole and it is forced through both the elliptical hole in the pipe and the through-hole in the die by pressing with a cam rod. The small ball is replaced with a larger ball and a secondary stage is performed using a second forming die having a larger through-hole. The larger ball is forced through the enlarged hole of the pipe and the larger through-hole of the second die using a second receiving stand and a second cam rod. Thus, a large diameter branch pipe joint is obtained.

Japanese Laid-Open Patent Application No. 55-122627 also relates to a method of producing a branching pipe. First, an elliptical hole is formed in a portion of a base pipe and the periphery of the hole is heated. A thickness-increasing die is forcibly inserted into the elliptical hole and then a forming die is pulled from inside of the elliptical hole to the outside. Thus, a branch pipe is obtained.

U.S. Pat. No. 1,792,928 relates to a method of forming a pipe outlet in a steel header pipe. A hole of an elliptical shape is punched or drilled in the wall of the header and is then enlarged by expanding the metal with an extrusion press.

U.S. Pat. No. 1,911,653 discloses a method of making pipe tees from a blank of wrought metal tubing. The ends of the blank are cut on transverse planes. A circular opening is formed in the blank, which is heated to a suitable flowing temperature and then placed in a cavity defined by upper and lower holding dies. A mandrel having a cylindrical recess, which receives a cylindrical former, is placed in the blank. When the blank is disposed upon the mandrel, the opening is concentric with the recess so that a pull rod can be secured to the former by a bayonet connection. Pressure dies are slidably mounted upon the mandrels and are forced toward each other by hydraulic pressure, for example. The pressure applying dies are then moved inwardly so as to displace and redistribute the metal at the upper portion of the blank. The metal of the blank may then flow outwardly through an opening of an upper holding die. The outward flow is guided by the cylindrical former, which is raised. Inward movement of the dies continues until the ends of the blank are normal to the longitudinal axis thereof. Thus, the pipe tee is formed.

U.S. Pat. No. 2,507,859 relates to a method of making pipe fittings in which a hole is cut into a tubular blank. The blank is then heated and positioned between upper and lower dies of a press. A pullout plug includes a round body, a neck and a head, which is passed from the interior of the blank through the hole. The head of the plug is inserted into a socket affixed to a supporting rod. As the upper die descends, the metal of the blank is drawn over the body of the plug to form the tee.

All of the processes just described use a pilot hole of either an elliptical or circular shape. However, elliptical pilot holes are difficult to machine. An inordinate amount of force is required to pass a forming member through elliptical and circular shaped pilot holes, which can give rise to tearing of the material. Further, such methods, especially when used in a hot-forming process, can give rise to uneven radiuses in the turn from the main bore to the tee. Moreover, these methods give rise to a thinning of the wall of the tubing in the tee portion. Thus, the coupling may be weakened in these areas and may not be satisfactory for high pressure applications.

BRIEF SUMMARY OF THE INVENTION

It is, therefore, a principal object of the present invention to provide a method and apparatus for forming tee joints in tubing with smooth turns.

It is another object of the present invention to provide a method and apparatus for forming such tee joints with walls of a substantially uniform thickness.

It is another principal object of the present invention to provide a method and apparatus for forming tee joints in tubing without consuming a large amount of energy. This can be achieved by forming the tee joints in a cold-forming process and by designing the pilot hole so that it does not require an overly large force to "pull" the tee.

In one aspect of the present invention, a method of forming a tee in tubing includes the steps of forming a quadrilobal pilot hole in the tubing and forcing a rounded member from the interior of the tubing through the pilot hole to form the tee in the tubing.

In another aspect of the present invention, a method of cold-forming a tee in tubing includes the steps of forming a pilot hole in the tubing and pulling a rounded member from the interior of the tubing, which is substantially unheated, through the pilot hole to form the tee in the tubing.

In still another aspect of the present invention, a manufacturing system for forming a tee in tubing includes means for forming a quadrilobal pilot hole in the tubing, means for securing the tubing, and means for forcing a rounded member from the interior of the tubing through the pilot hole to form the tee in the tubing.

In yet a further aspect of the present invention, an apparatus for cold-forming a tee in tubing includes means for forming a pilot hole in the tubing, means for securing the tubing, and means for pulling a rounded member from the interior of the tubing, which is unheated, through the pilot hole to form the tee in the tubing.

Throughout the specification the term "tee" is not intended to be limited to a 90° joint, but rather a branch disposed at any angle relative to its main.

These and other aspects, objects and features of the present invention will be more readily understood by taking into consideration the following detailed description and accompanying drawings.

DETAILED DESCRIPTION OF THE INVENTION

Figure 1:
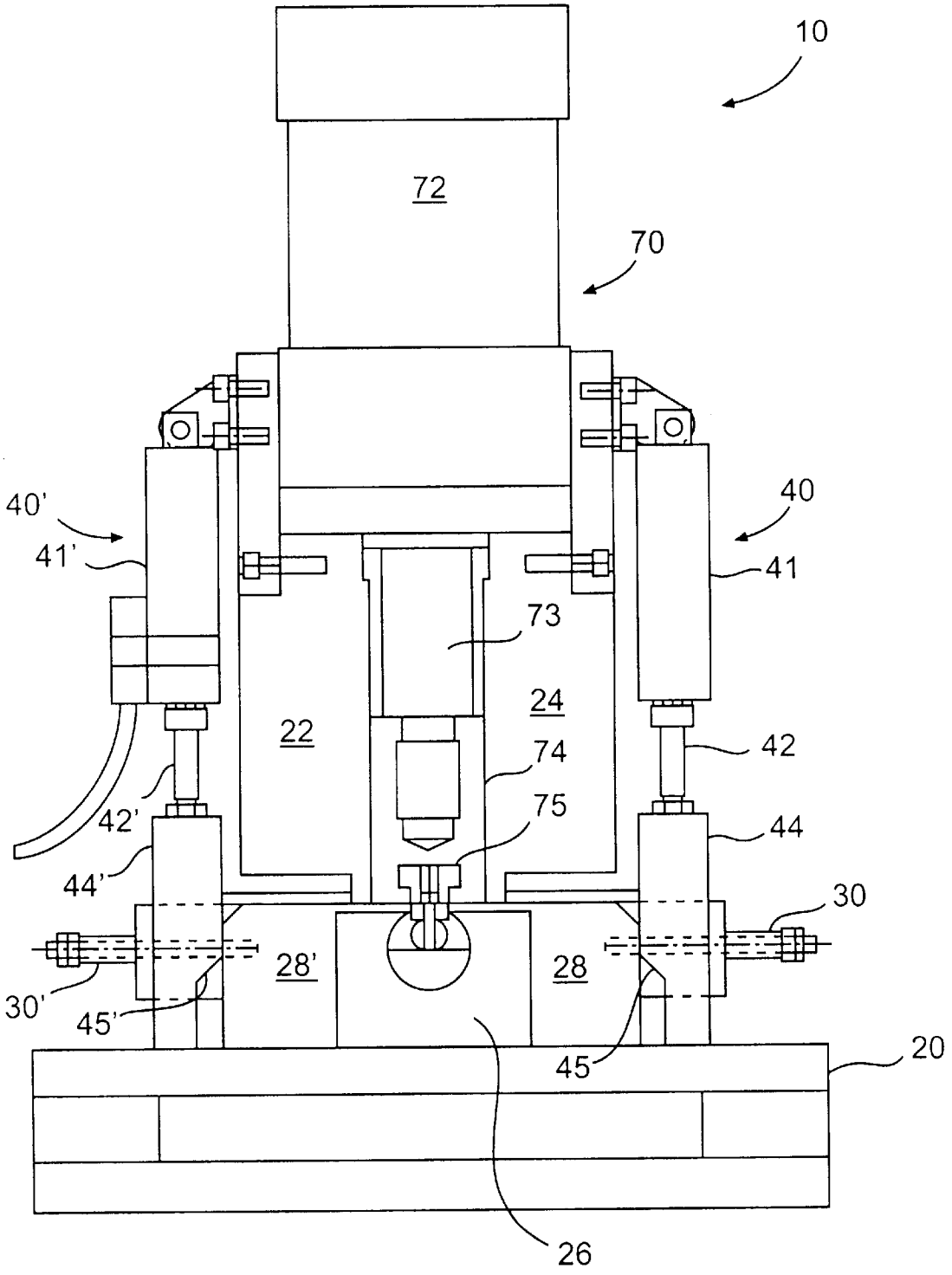
FIG. 1 is a front view of the tee forming apparatus of the present invention.
Figures 2A, 2B:
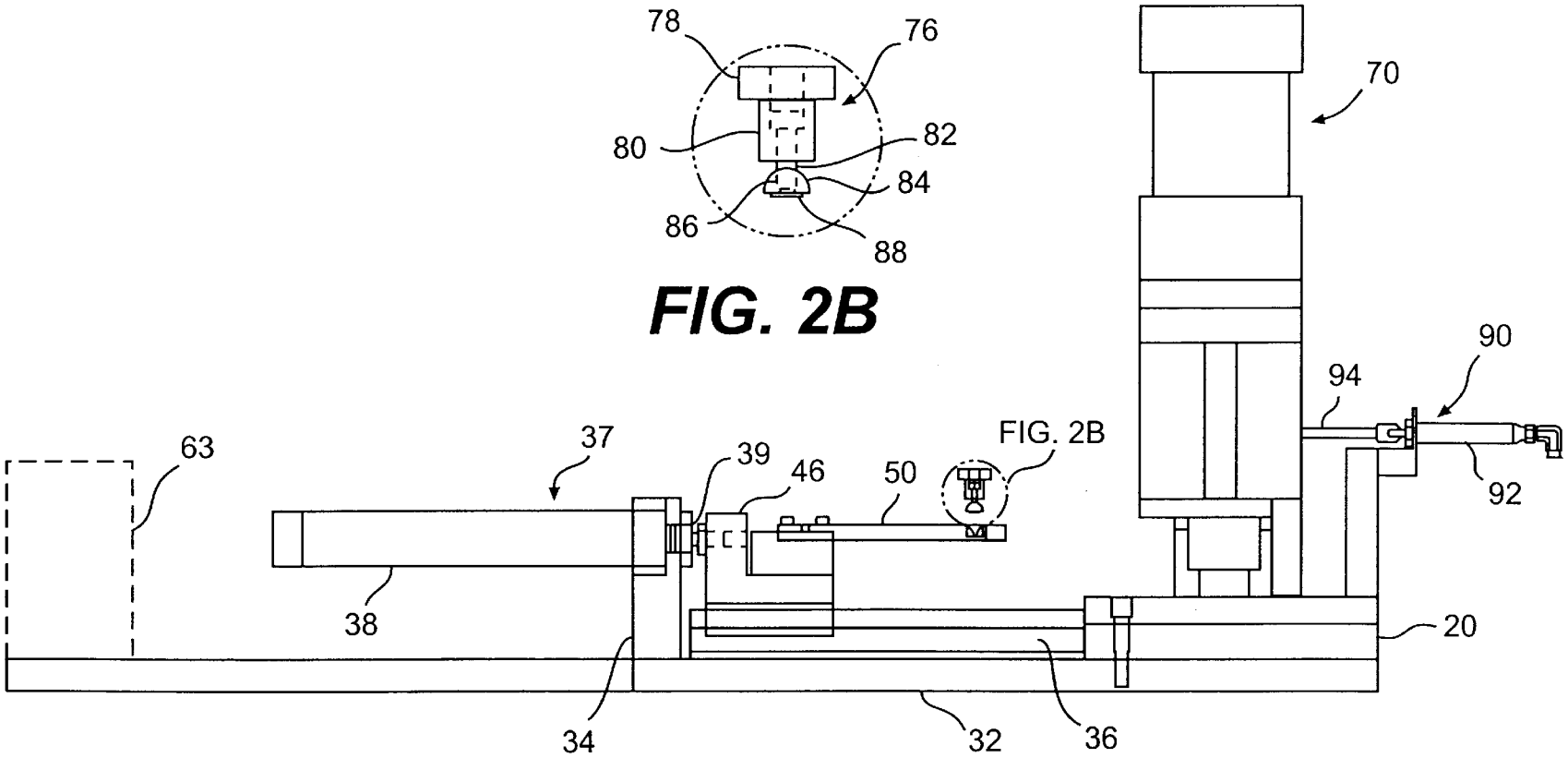
FIG. 2A is a side elevational view of the apparatus of the present invention.
FIG. 2B is an enlarged view of the puller ball and pin shown in FIG. 2A.

The tee-joint-forming apparatus 10 of the present invention is generally shown in elevation in FIGS. 1 and 2A. The joint-forming apparatus 10 basically includes a clamping system, mandrel conveying system and pulling system, each of which can be individually controlled and which will be described in detail below.

Figure 5D:
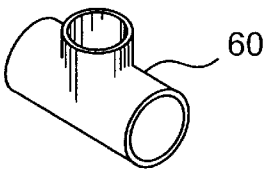
FIGS. 5A–5D show the process of forming the tee in the tubing.
Figure 5B:
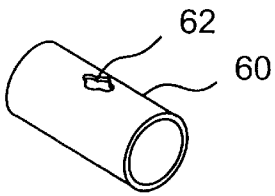
Figure 5C:
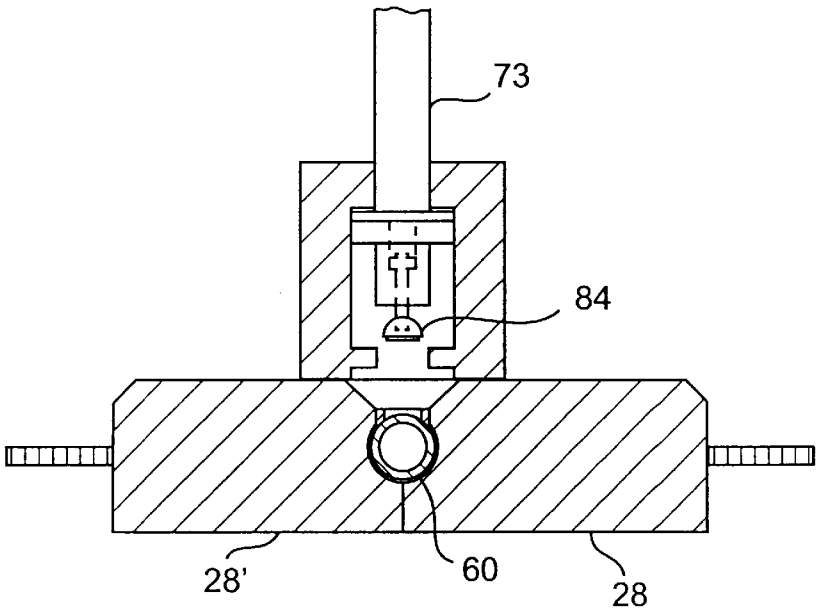
Figure 5A:
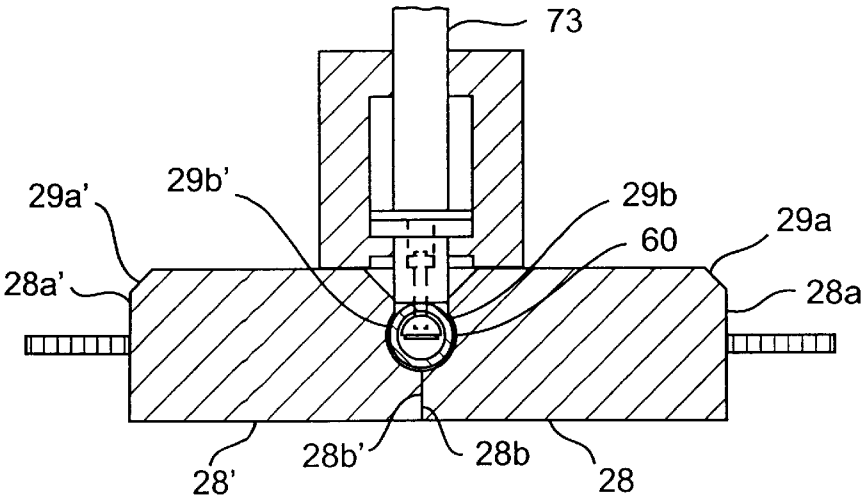

The apparatus 10 includes a horizontal base 20 on which vertical frame members 22 and 24 are secured. A block 26 is also mounted on the base 20. The block 26 includes two relatively movable clamps 28, 28' that can secure a work piece in the block. These clamps are disposed at the "pulling region" of the apparatus and are shown in more detail in FIGS. 5A and 5B. The clamps 28, 28' are mounted in recesses in the block, in which they can slide horizontally toward and away from one another. Each of the clamps includes a driven end 28*a*, 28*a*' and a mating end 28*b*, 28*b*'. Each driven end 28*a*, 28*a*' includes a cam surface 29*a*, 29*a*' and each mating end 28*b*, 28*b*' includes a mating surface 29*b*, 29*b*'. The mating surface 29*b* of clamp 28 is a mirror image of the mating surface 29*b*' of clamp 28'. The clamps are spring-biased away from a mating direction by springs 30, 30'.

Vertically disposed clamping actuators 40, 40' are mounted to the vertical frame members 22, 24. Each clamping actuator includes a cylinder 41, 41' in which is movably disposed a piston (unshown) attached to a piston rod 42, 42'. At the end of each piston rod is affixed a cam actuator 44, 44'. Each cam actuator includes an actuator surface 45, 45' engageable with the cam surface 29*a*, 29*a*' of one of the clamps 28, 28'. When the pistons in the cylinders 41, 41' are actuated to their upper positions, the actuator surfaces 45, 45' of the cam actuators 44, 44' do not contact the cam surfaces of the clamps 28, 28'. However, when the pistons are actuated to the lower positions, the actuator surfaces of the cam actuators do contact the cam surfaces of the clamps 28, 28', to force the clamps toward one another in the mating direction. The clamping actuators 40, 40' are preferably pneumatically operated. The block 26, clamps 28, 28' and clamping actuators 40, 40' basically comprise the clamping system of the joint-forming apparatus 10.

The base 20 also includes an arm 32 as shown in detail in FIG. 2A. The arm 32 includes a mandrel actuator mount bracket 34 and mandrel guide 36. A mandrel actuator 37 is secured to the mount bracket 34. The mandrel actuator 37 includes a cylinder 38 carrying an unshown piston, which is attached to piston rod 39. A mandrel sled 46 is positioned to be slidable in the mandrel guide 36 and can mount any one of a plurality of exchangeable mandrels 50. The piston rod 39 of the mandrel actuator 37 is secured to the mandrel sled 46 to slide it along the mandrel guide 36 toward and away from the clamps 28, 28' at the pulling region of the, joint-forming apparatus. The mandrel guide 36, mandrel actuator 37, and sled 46 b asically comprise the mandrel conveying system of the joint-forming apparatus 10.

Figure 3:
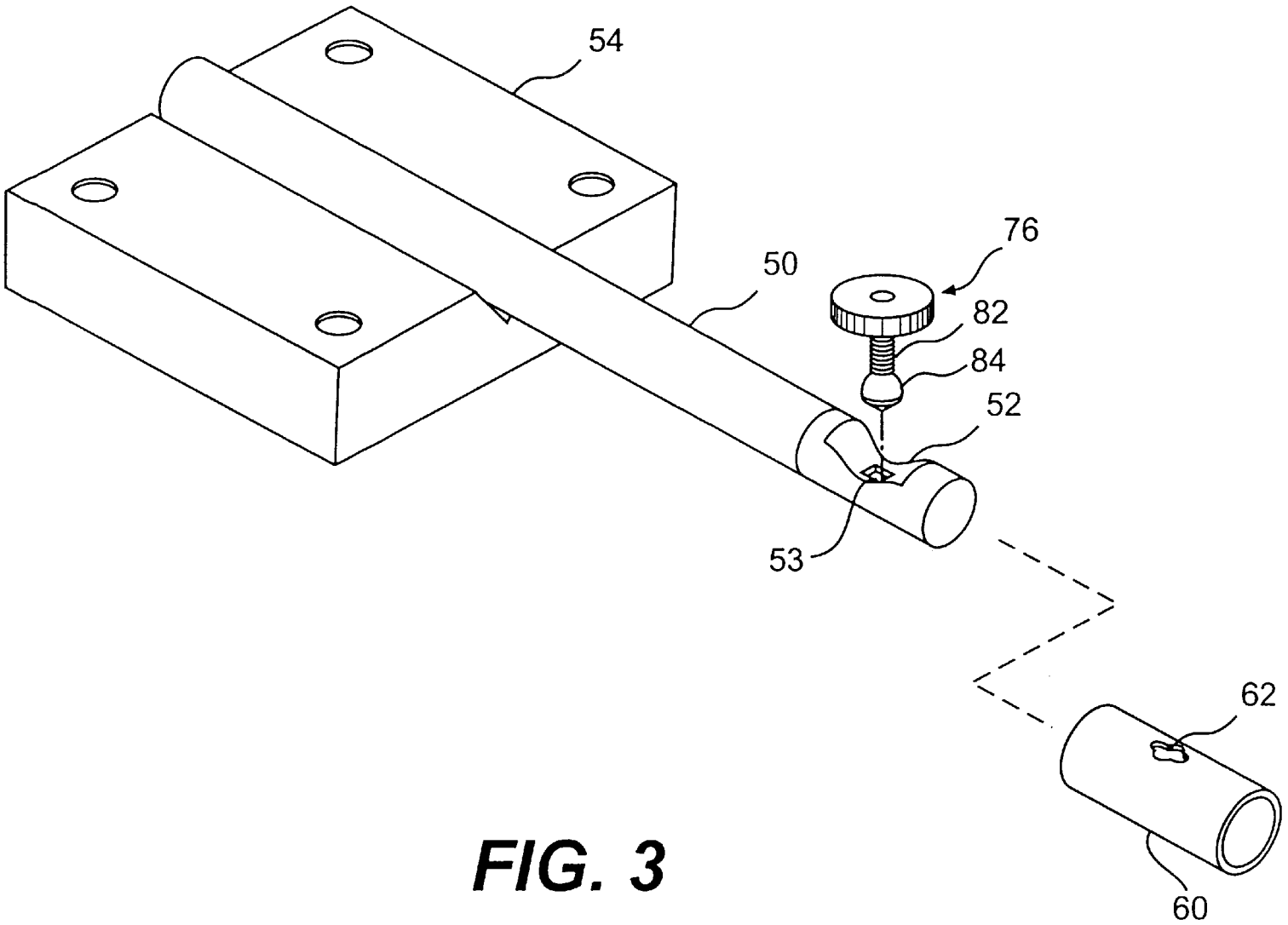
FIG. 3 is a perspective view of the mandrel of the apparatus of the present invention.
Figure 4A:
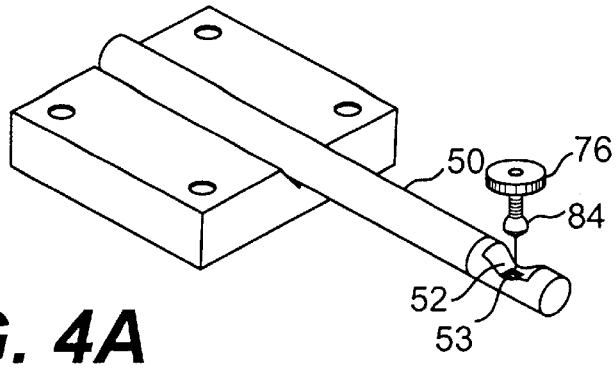
FIGS. 4A–4D show steps of loading the blank and puller ball in the apparatus of the present invention.
Figure 4B:
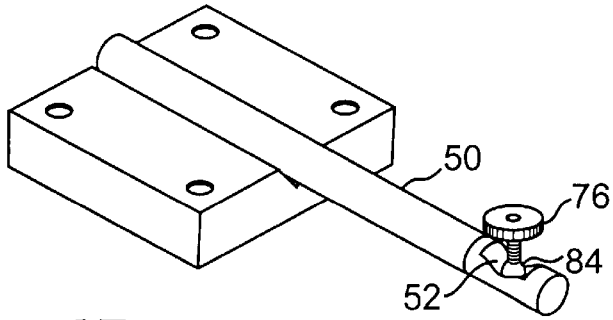
Figure 4C:
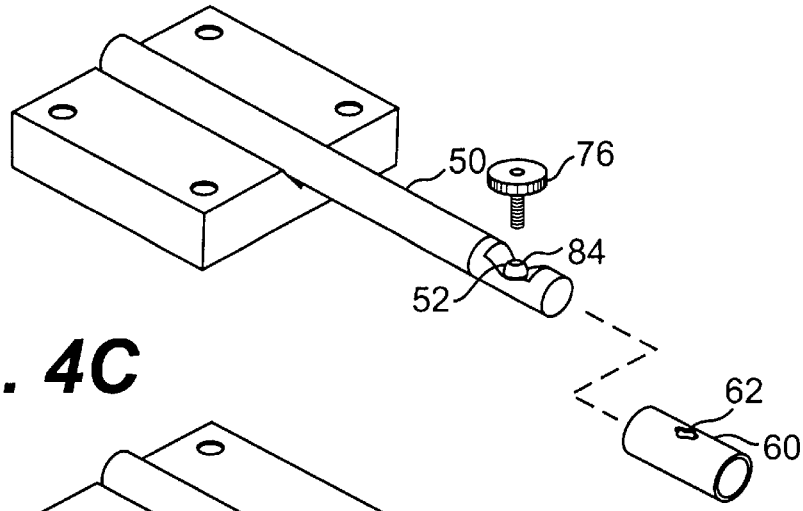
Figure 4D:
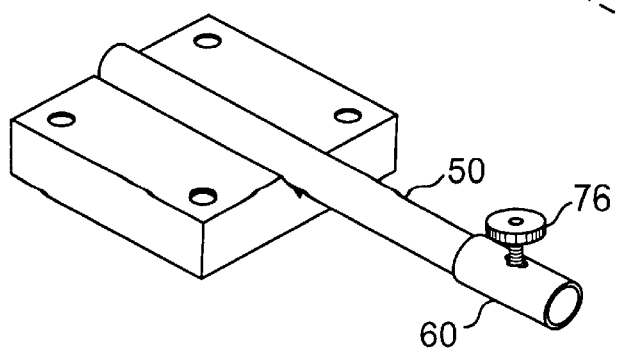

A typical mandrel 50 is shown in more detail in FIG. 3. The mandrel 50 is in the shape of a cylindrical rod and includes a recess 52 on one end and a mounting block 54 on the other. At the base of the mandrel recess 52 is formed a sub-recess 53 of a preferably squared shape. The mandrel can receive a blank 60 comprising the main tube in which the tee joint is to be formed. When the blank 60 is mounted on the mandrel 50, the blank can be conveyed to the pulling region using the mandrel conveying system.

A pulling actuator 70 is also affixed to the vertical frame members 22, 24. The pulling actuator 70 is preferably hydraulically actuated, because greater forces can be generated thereby, as compared with pneumatic actuation. A piston rod 73 is connected to an unshown piston in a pulling cylinder 72. A puller adapter 74 is secured to the free end of the puller piston rod 73. The puller adapter 74 includes a T-shaped slot 75 for engaging a puller button 76.

The puller button 76 is shown in detail in FIG. 2B. The puller button 76 is basically T-shaped in cross-section and includes a head 78 and body 80. The body 80 includes a male threaded portion 82. The head 78, body 80 and threaded portion 82 of the puller button 76 are rigidly secured so that rotation of the head member 78 will cause rotation of the threaded portion 82.

The puller button 76 can be removably connected to a puller ball 84. As shown in FIG. 2B, the puller ball 84 is generally hemispherical in shape and includes internal female threads 86 for mating with the threaded portion 82 of the puller button 76. The puller ball 84 further includes a square-shaped projection 88 that can mate with the squared sub-recess 53 of the mandrel 50. Therefore, when the puller ball 84 is placed in the recess 52 in the mandrel 50, it cannot be rotated relative to the mandrel, because of the mating of the projection 88 and the sub-recess 53.

Also mounted on the base 20 is a puller button ejection unit 90 a s shown in FIG. 2A. The ejection unit 90 includes a fluid actuator 92 for driving an ejector pin 94. The ejector pin 94 is positioned at a height such that when the pulling actuator 70 is at its fully raised position, the ejector pin 94 can be actuated to push the puller button 76 out of the puller adapter 74.

The pulling actuator 70, puller adapter 74, puller button 76, and the puller button ejection unit 90 basically comprise the pulling system of the joint-forming apparatus 10.

The joint-forming apparatus 10 includes an unshown controller for controlling the clamping system, mandrel positioning system, and pulling system at precise timings. Such a controller can include a conventional microprocessor, which can readily be programmed by one of ordinary skill in programming numerically controlled tools.

The process of forming the tee joint in a blank 60 by use of the joint-forming apparatus 10 will now be described.

As shown in the drawings, a quadrilobal pilot hole 62 is formed in the blank 60. The pilot hole 62 can be milled, punched or plasma cut into the blank 60 by a pilot-hole-forming device 63. Such a pilot-hole-forming device 63 can be integrally incorporated into the joint-forming apparatus 10, as schematically shown in phantom FIG. 2A, and controlled by its controller. The specific dimensions of the pilot hole 62 will be described in more detail below.

With the mandrel actuator 37 in its retracted position, a puller ball 84 of an appropriate size is inserted into a mandrel 50 of a size appropriate for the size of the blank. The selected size of the mandrel 50 should be of a diameter close to the inner diameter of the blank 60, so that there is little or no tolerance. The squared protrusion 88 on the puller ball 84 is engaged in the squared sub-recess 53 of the mandrel 50. The blank 60 is then slid over the mandrel 50 with the pilot hole 62 disposed directly over the female threads 86 of the puller ball 84. The male threads 82 of the puller button 76 are then inserted through the pilot hole 62 and screwed into the female threads 86 of the puller ball 84. The mandrel actuator 37 is then actuated to urge the mandrel 50, the blank 60 and puller button/puller ball assembly toward the pulling region.

At this time, the piston of the pulling actuator 70 is in its extended or lower position and the pistons of the clamping actuators 40, 40' are in their retracted positions. The T-shaped slot 75 of the puller adapter 74 is aligned with the T-shaped head 78 and body 80 of the puller button 76. As the mandrel actuator 38 continues to move the blank 60 toward the pulling region, the head 78 and body 80 of the puller button 76 slide into the slot 75 of the puller adapter 74. At this point, the mandrel actuator 37 is stopped.

Then the clamping actuators 40, 40' are actuated to force the clamps 28, 28' into the mating position to hold the mandrel 50 and blank 60 securely in the block 26. When the clamps 28, 28' are mated, the pulling actuator 70 is then actuated. As the piston of the pulling actuator 70 is moved toward its raised or retracted position, the puller ball 84 is pulled out of the interior of the blank 60 through the pilot hole 62. The region of the blank 60 surrounding the pilot hole 62 is forced outwardly and against the neck portion of the clamps 28. This working of the metal forms the tee of the blank 60.

After the piston of the puller actuator 70 is moved to its fully retracted position, the puller ball ejector pin 94 is actuated to eject the puller button 76 from the puller adapter 74. Also, the clamping actuators 40, 40' are actuated to raise the cam actuators 44, 44' and release the clamps 28, 28'. The mandrel actuator 38 is then retracted to remove the mandrel 50 and the blank 60 from the pulling region. When the mandrel actuator 38 is in its fully retracted position, the blank 60 can be removed from the mandrel 50. If desired, edges of the blank can be smoothed and squared.

Figure 6:
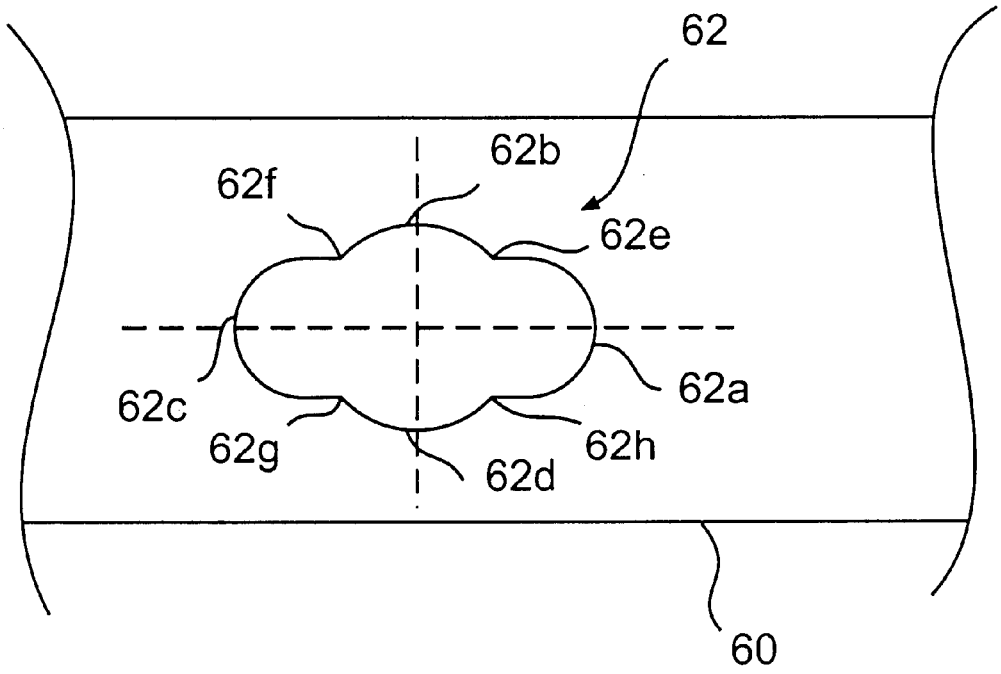
FIG. 6 is a detail of the quadrilobal pilot hole of the present invention.

The shape of the pilot hole 62 of the blank 60 is shown more clearly in FIG. 6. The hole has two, diametrically opposed axes (shown with broken lines), one of which (the longitudinal axis that is parallel with the axis of the tubing) is longer than the other (the transverse axis). The pilot hole 62 includes four lobes 62*a*–62*d* and is symmetrical about both axes. The first pair of lobes 62*a*, 62*c* is centered on the longitudinal axis of the hole. The second pair of lobes 62*b*, 62*d* is centered on the transverse axis of the hole. The radius of curvature of each lobe in a pair is substantially the same. However, the radius of curvature of each lobe of the first pair of lobes 62*a*, 62*c* is smaller than that of each lobe of the second pair of lobes 62*b*, 62*d*. Thus, as indicated, the pilot hole 62 is longer in the longitudinal direction of the blank 60 than in the transverse direction.

A point of inflection 62*e*–62*h* is defined between each pair of adjacent lobes 62*a*–62*d*. For example, point of inflection 62*e* is defined between adjacent lobes 62*a* and 62*b*. Each point of inflection is defined as where the perimeter of pilot hole 62 changes from a concave shape to a convex shape.

The lobes are formed by first forming an elongated slot along the longitudinal axis with rounded ends and straight, parallel sides. The rounded ends form lobes 62*a* and 62*c*. Then a circular hole is formed, centered on the center of the elongated slot. This circular hole forms lobes 62*b* and 62*d* and has a diameter greater than the width of the slot but less than the length of the slot. Alternatively, in forming the pilot hole 62 the circular hole can be formed prior to the slot. As is evident, the diameter of this circular hole becomes the transverse axis of the pilot hole.

The dimensions of the pilot hole will vary for tubing of various sizes. For example, to form a 0.50 in. OD tee in a 1.00 in. OD tubing with 0.020 in. tubing thickness, a puller ball of a 0.406 in. diameter is used, and the pilot hole is dimensioned such that the diameter of the circular hole is 0.166 in. with the radius of curvature of lobes 62*b* and 62*d* being 0.084 in.

The length of the slot is preferably 0.322 in. with its width being 0.140 in. The radius of curvature of lobes 62*a* and 62*c* at the ends of the slot are preferably 0.070 in.

In another example, when pulling a 0.750 in. tee in 1.0 in. OD tubing, a 0.635 in. ball is used and the pilot hole is dimensioned such that the diameter of the circular portion is preferably 0.248 in., with the length and width of the slot being 0.500 in. and 0.188 in., respectively. Of course, the particular dimensions of the pilot hole and the puller ball will vary depending on the OD of the tee to be pulled and the thickness of the tubing.

In the preferred embodiments of the pilot hole, the ratio of the length of the slot to the diameter of the circular portion of the pilot hole is preferably in the range of about 1.9 to 2.1, the ratio of the length of the slot to the width of the slot is preferably about 2.1 to 2.8, and the ratio of the diameter of the circular portion to the width of the slot is preferably about 1.1 to 1.5.

The diameter of the circular portion of the pilot hole is preferably dimensioned to be slightly larger than the diameter of the male threads 82 of the puller button 76. For example, the diameter of the male threads 82 of puller button 76 is preferably dimensioned to be about 0.164 in. in the first example, in which the diameter of the circular hole is 0.166 in. This allows a sufficiently large screw to be used with a slot of a relatively small area and aids in centering the male threads 82 of the puller button 76 onto the female threads of the puller ball 84 when attaching the puller button to the puller ball.

The quadrilobal configuration of the pilot hole is more effective than an elliptical shape because it is easier to machine and requires less force to pull a ball through the hole, and will eliminate some tearing during pulling. We have found, in fact, that the blank 60 need not be heated during the pulling step to achieve satisfactory results.

While the present invention has been described with respect to what is currently considered to be the preferred embodiments, it is to be understood that the invention is not limited thereto. To the contrary, the invention is intended to cover various modifications and equivalent arrangements within the spirit and scope of the appended claims. The scope of the following claims is to be accorded the broadest interpretation so as to encompass all such modifications and equivalent structures and functions.

What is claimed is:

1. A method of forming a tee in tubing, said method comprising the steps of:

forming a quadrilobal pilot hole in the tubing, the quadrilobal pilot hole being defined by four contiguous lobes with two adjacent lobes being connected by a point of inflection; and forcing a rounded member from the interior of the tubing through the pilot hole to form the tee in the tubing.

2. A method according to claim 1, wherein during said forcing step the tubing is unheated.

3. A method according to claim 1, further comprising a step of securing the tubing with an internal mandrel and external clamping means prior to said forcing step.

4. A method according to claim 3, wherein prior to said forcing step the rounded member is positioned in the interior of the tubing in a recess in the mandrel.

5. A method according to claim 1, wherein said hole forming step is effected by milling, punching or plasma cutting.

6. A method according to claim 1, wherein the quadrilobal pilot hole comprises a first pair of lobes disposed along the longitudinal axis of the tubing and a second pair of lobes disposed along a line transverse to the longitudinal axis.

7. A method according to claim 6, wherein the first pair of lobes is defined by a slot formed in the tubing and the second pair of lobes is defined by a circular hole formed in the tubing, the circular hole being concentric with the center of the slot.

8. A method according to claim 7, wherein the ratio of the length of the slot to the diameter of the circular hole is in the range of about 1.9 to 2.1.

9. A method according to claim 7, wherein the ratio of the diameter of the circular hole to the width of the slot is in the range of about 1.1 to 1.5.

10. A method according to claim 6, wherein the distance between the first pair of lobes is longer than the distance between the second pair of lobes.

11. A method according to claim 6, wherein the radius of curvature of each lobe of the second pair of lobes is longer than the radius of curvature of each lobe of the first pair of lobes.

12. A method according to claim 1, wherein the tubing comprises stainless steel.

13. A method according to claim 1, wherein said forcing step comprises pulling the rounded member through the pilot hole.

14. A method of cold-forming a tee in tubing, said method comprising the steps of:

forming a quadrilobal pilot hole in the tubing, the quadrilobal pilot hole being defined by four contiguous lobes with two adjacent lobes being connected by a point of inflection; and pulling a rounded member from the interior of the tubing, which is unheated, through the pilot hole to form the tee in the tubing.

15. A method according to claim 14, further comprising a step of securing the tubing with an internal mandrel and external clamping means prior to said pulling step.

16. A method according to claim 15, wherein prior to said pulling step the rounded member is positioned in the interior of the tubing in a recess in the mandrel.

17. A method according to claim 14, wherein said hole forming step is effected by milling, punching or plasma cutting.

18. A method according to claim 14, wherein the tubing comprises stainless steel.

19. A manufacturing system for forming a tee in tubing, said system comprising:

means for forming a quadrilobal pilot hole in the tubing, the quadrilobal pilot hole being defined by four contiguous lobes with two adjacent lobes being connected by a point of inflection;

means for securing the tubing; and means for forcing a rounded member from the interior of the tubing through the pilot hole to form the tee in the tubing.

20. A manufacturing system according to claim 19, wherein said forcing means forces said rounded member through the pilot hole when the tubing is unheated.

21. A manufacturing system according to claim 19, wherein said securing means comprises a mandrel received in the interior of the tubing and clamping means surrounding the exterior of the tubing.

22. A manufacturing system according to claim 21, wherein said mandrel comprises a recess for receiving the rounded member.

23. A manufacturing system according to claim 19, wherein said forcing means comprises a connector connectable to the rounded member through the pilot hole and a rod connectable to the connector.

24. A manufacturing system according to claim 23, wherein said rod comprises a piston rod of a piston-cylinder actuator actuated by hydraulic pressure.

25. A manufacturing system according to claim 19, wherein said pilot hole forming means comprises means for milling, punching or plasma cutting the pilot hole in the tubing.

26. A manufacturing system according to claim 19, wherein the quadrilobal pilot hole comprises a first pair of lobes disposed along the longitudinal axis of the tubing and a second pair of lobes disposed along a line transverse to the longitudinal axis.

27. A manufacturing system according to claim 26, wherein the first pair of lobes is defined by a slot formed in the tubing and the second pair of lobes is defined by a circular hole formed in the tubing, the circular hole being concentric with the center of the slot.

28. A manufacturing system according to claim 27, wherein the ratio of the length of the slot to the diameter of the circular hole is in the range of about 1.9 to 2.1.

29. A manufacturing system according to claim 27, wherein the ratio of the diameter of the circular hole to the width of the slot is in the range of about 1.1 to 1.5.

30. A manufacturing system according to claim 27, wherein said forcing means comprises a connector connectable to the rounded member through the pilot hole and a rod connectable to the connector, said connector comprising a threaded shaft having a diameter slightly less than the diameter of the circular hole.

31. A manufacturing system according to claim 26, wherein the distance between the first pair of lobes is longer than the distance between the second pair of lobes.

32. A manufacturing system according to claim 26, wherein the radius of curvature of each lobe of the second pair of lobes is longer than the radius of curvature of each lobe of the first pair of lobes.

33. A manufacturing system according to claim 19, wherein the tubing comprises stainless steel.

34. An apparatus for cold-forming a tee in tubing, said apparatus comprising:

means for forming a quadrilobal pilot hole in the tubing, the quadrilobal pilot hole being defined by four contiguous lobes with two adjacent lobes being connected by a point of inflection;

means for securing the tubing; and means for pulling a rounded member from the interior of the tubing, which is unheated, through the pilot hole to form the tee in the tubing.

35. An apparatus according to claim 34, wherein said securing means comprises a mandrel received in the interior of the tubing and clamping means surrounding the exterior of the tubing.

36. An apparatus according to claim 34, wherein said mandrel comprises a recess for receiving the rounded member.

37. An apparatus according to claim 34, wherein said pulling means comprises a connector connectable to the rounded member through the pilot hole and a rod connectable to the connector.

38. An apparatus according to claim 37, wherein said rod comprises a piston rod of a piston-cylinder actuator actuated by hydraulic pressure.

* * * * *